US006108957A

United States Patent [19]

Zapawa

[11] Patent Number: 6,108,957

[45] Date of Patent: Aug. 29, 2000

[54] PROTECTIVE TICKET HOLDER AND MEMORABILIA DEVICE

[76] Inventor: Timothy J. Zapawa, 5951 Lodewyck, Detroit, Mich. 48224-1311

[21] Appl. No.: 09/116,280

[22] Filed: Jul. 16, 1998

Related U.S. Application Data

[63] Continuation-in-part of application No. 08/653,175, May 24, 1996, Pat. No. 5,784,816.

[51] Int. Cl.[7] ..... G09F 3/18

[52] U.S. Cl. ..... 40/654.01; 40/661.08; 40/1.6; 283/109

[58] Field of Search ..... 40/1.5, 1.6, 124.2, 40/5, 654.01, 661, 765, 776; 283/77, 106, 107, 109, 112, 900; 150/147, 148, 145

[56] References Cited

U.S. PATENT DOCUMENTS

| | | | |
|---|---|---|---|
| 193,382 | 7/1877 | Pinney et al. . | |
| 513,749 | 1/1894 | Atherton . | |
| 954,336 | 4/1910 | Patton . | |
| 1,466,729 | 8/1921 | Riley . | |
| 1,666,006 | 8/1928 | Duncan . | |
| 1,690,083 | 10/1928 | Waterman . | |
| 2,431,472 | 11/1947 | Fistell | 40/530 X |
| 2,725,913 | 4/1955 | Horwin . | |
| 3,216,135 | 11/1965 | Wright . | |
| 3,295,235 | 1/1967 | Tauber . | |
| 3,350,799 | 11/1967 | Japs . | |
| 3,360,027 | 12/1967 | Price | 150/147 X |
| 3,433,279 | 3/1969 | Seamon | 150/145 X |
| 3,464,135 | 9/1969 | Eidinger | 40/661 X |
| 3,657,834 | 4/1972 | Tauber . | |
| 3,829,995 | 8/1974 | Fakoury | 40/586 X |
| 4,259,797 | 4/1981 | Belser . | |
| 4,350,195 | 9/1982 | Viesturs et al. | 150/147 |
| 4,435,912 | 3/1984 | Adrian et al. | 40/626 X |
| 4,509,277 | 4/1985 | Bolton | 40/1.5 |
| 4,706,396 | 11/1987 | Nomura | 40/124.2 |
| 4,722,376 | 2/1988 | Rhyner | 40/1.5 X |
| 4,942,913 | 7/1990 | Musso | 150/147 X |
| 5,000,319 | 3/1991 | Marmelstein | 40/776 X |
| 5,090,732 | 2/1992 | Kuhns et al. . | |
| 5,380,046 | 1/1995 | Stephens | 283/107 X |
| 5,388,739 | 2/1995 | Gargan . | |
| 5,431,207 | 7/1995 | Siegel | 150/147 X |
| 5,461,810 | 10/1995 | Goserud . | |
| 5,784,816 | 7/1998 | Zapawa | 40/1.6 X |
| 5,799,774 | 9/1998 | Dengel | 150/147 X |

*Primary Examiner*—Brian K. Green
*Attorney, Agent, or Firm*—Rader, Fishman & Grauer PLLC

[57] ABSTRACT

A ticket holder adapted to be worn by a patron is disclosed, the ticket holder including first and second cards that have insert portions. The first and second cards are aligned and secured together to form a generally hidden pocket. One of the cards has an aperture formed on a portion of an outer periphery of the card for connecting to a retaining element to permit attaching to a holder to a user. The ticket holder further comprises a hinged panel that is pivotal about a predetermined axis to permit pivotal movement between the hinge panel and the one card such that substantially an entire inner surface of the hinged panel may be selectively viewed by a user.

17 Claims, 7 Drawing Sheets

PROTECTIVE TICKET HOLDER AND MEMORABILIA DEVICE

This application is a continuation-in-part of Ser No. 08/653,175 of U.S. Pat. No. 5,784,816, issued on Jul. 28, 1998, which is incorporated herein by reference for all purposes.

FIELD OF THE INVENTION

The present invention relates to a ticket holder and more particularly to a protective ticket holder secured to at least one laminated card capable of displaying additional information.

BACKGROUND OF THE INVENTION

When attending entertainment events such as concerts, sporting events, fairs, plays, and the like, or when commuting, ticket stubs must usually be retained by a patron. The ticket stubs are typically used to ensure proper seating and to show authorization to be present in a specific location at a particular time.

Unfortunately, however, ticket stubs are often lost or misplaced, resulting in problems for security personnel, ushers, or conductors, and embarrassment and grief for the patron. Further, particularly when attending entertainment events, a patron may want to retain the ticket stub as a souvenir of the event attended. Yet, even if not lost, ticket stubs are often damaged through normal usage at the event, with bent comers, scuffs, crumpling or tears. Thus, the sentimental and possible monetary value of the ticket stub as a souvenir is reduced for the patron. Even when patrons have properly saved the ticket stubs, the patrons often have their hands filled with food and beverages, articles of clothing or other items making it very inconvenient for them to search for, retrieve and display their ticket stubs to authorized personnel upon request.

Additionally, ticket issuers, as well as patrons, often encounter clever forgeries of tickets, leading to troubling situations where patrons desiring to attend entertainment events are deceived by unscrupulous counterfeiters and where patrons are prevented from attendance. Such ticket issuers also may wish to limit access to some areas to only particular classes of attendees, as, for example, limiting attendance in student sections to students only. Frequently, the ticket issuers may be forced to expend additional money on personnel or security devices to prevent any fraudulent compromise of the ticket from occurring. Ticket issuers may include, for example, the use of sophisticated holograms on the ticket itself or even require that picture identification be presented with the ticket to permit entry into the event. Such precautions become expensive for the issuer and inconvenient for the patron, especially in multi-event seasons such as sporting seasons. Other patrons, particularly season ticket holders, often desire to keep in a single safe location their season parking pass, only one of which is usually issued, which must be presented along with the ticket for the particular event when parking.

Additionally, patrons desire a safe place in which to conceal and protect small items like identification cards, money, or the like. At some events, patrons would rather not carry a purse or a wallet due to fear of loss or theft, as well as due to the inconvenience of carrying and safeguarding such an item. However, the patron may not have sufficient pockets available within which to carry items such as cash, credit cards, identification, parking passes, or the like.

Further, in addition to the ticket stubs, many patrons of entertainment events often desire a displayable souvenir bearing a team logo, band picture, or the like. The merchandising of collectible memorabilia has become a big business at entertainment events around the world. Many items sold as collectible memorabilia are often articles of clothing such as caps, shirts and coats. Other items include mugs, key chains and pictures, but such items are not as readily displayable, particularly when attending the event itself.

Various types of transparent holders are known in the prior art. They generally pertain to the retention and display of convention badges, identification cards, commuter tickets and the like. However, many of the holders require a pocket to use the device. Others require the use of pins or other clothing attachment which may damage clothing or the device. The prior art includes a badge with a means for retaining the badge on an article of clothing and a ticket with a pressure sensitive adhesive on the stub portion so that it may be attached to clothing. However, either the badge or ticket stub or the clothing may be damaged when removed. Further, only one side of such a device is able to be seen at any time, and that side does not allow for the display of information other than the ticket or badge itself.

Additionally, one of the holders known to the inventor includes a plastic envelope that is secured to a neck band. The envelope may hold a ticket. The device is designed such that the front of the envelope will always lie flat with only the front of the ticket viewable at all times. Thus, the invention teaches the importance of displaying only a single side of the holder. Further, while a small self-adhesive advertising sticker may be affixed to the holder, the sticker is not intended to be prominent. Nor is it protected from damage. Additionally, the sticker lacks aesthetic value, as well as any sentimental or actual value to the ticket-holder.

SUMMARY OF THE INVENTION

An inventive protective ticket holder and memorabilia device is disclosed wherein a protective ticket holder is secured to a laminated card capable of displaying additional information, the combination adapted to being conspicuously worn to display both a ticket and the card. The card may include such things as a team logo, a parking pass, or a security device while allowing easy access to the ticket received in the ticket holder. Thus, the information displayed on the card may have use independent of the ticket itself, or may be an authentication device for the ticket. A second embodiment of the invention includes two laminated cards, each displaying additional information wherein the two cards are configured to conceal a pocket to further allow the patron to safeguard items therewithin. The protective ticket holder is secured to the front face of one of the laminated cards. A third embodiment of the invention is manufactured from a single elongated sheet of transparent plastic material which is folded along an odd number of fold lines. An insert may be sealed within the folds to display information. A protective ticket holder constructed from a single rectangular piece of transparent material is bonded along three of its borders to the outside face of the sheet with a transparent pressure sensitive adhesive.

More specifically, a first embodiment of the invention includes a generally rectangular transparent laminated card, with the card including aligned rear and front panels with a common outer periphery, an insert disposed between the rear panel and the front panel with information printed on at least a portion of the insert which is in facing contact with the rear panel. The insert is spaced away from the outer periphery, and the rear panel is bonded to the front panel along the outer periphery. An aperture is formed along a portion of the outer periphery. Further, a generally rectangular transparent ticket pocket is bonded to the card. The ticket pocket includes aligned rear and front partitions in facing relation to one another which are sealed along three sides with the pocket open along a fourth side. The ticket pocket is smaller than the card.

In a second embodiment, a protective ticket holder is disclosed which includes a second transparent laminated card with its own insert. The second card is positioned in a facing relationship with the first card, whereby the front panel of the second card is placed against the rear panel of the first card. The first card is bonded to the second card along three sides in such a way as to create a concealed pocket between the two cards. Thus, the insert of the first card typically displays information which is in facing contact with its front panel, while the insert of the second card typically displays information which is in facing contact with its rear panel. It may be desirable to print information upon the portion of the insert of the first card which is in facing contact with its rear panel and upon the portion of the insert of the second card which is in facing contact with its front panel. In this way, information is hidden with the concealed pocket which is revealed when the pocket is opened. In this embodiment, the top portion of the first card is dimensioned longer than the top portion of the second card, and an aperture formed along the longer top portion of the first card. Finally, a generally rectangular transparent ticket pocket is included which is bonded to the front panel of the first card. The ticket pocket has aligned rear and front partitions in facing relation to one another which are sealed along three sides with the pocket open along a fourth side. The ticket pocket is smaller than the cards.

In a third embodiment, a protective ticket holder and method for making it are disclosed. The holder comprises a single sheet of flexible plastic material formed into a generally rectangular or otherwise elongated shape. An odd number of fold lines are made in the sheet in a direction perpendicular to the longest side of the sheet. In this way, the sheet is divided into an even number of panels. The fold lines alternate in opposite directions to provide the sheet with an accordion-like shape. A printed insert is placed between the accordion-shaped panels such that the printed matter is visible through at least one outermost panel. The assembly is then sealed along the three edges of the outermost panels which do not include a fold line. In this way, a concealed pocket to safeguard items therewithin is formed between the outermost panels, with the pocket opening defined by the fold lines of the outermost panels. A ticket pocket made from a single rectangular piece of transparent material may be bonded to the external face of one of the outermost panels with a pressure sensitive adhesive applied to three borders of the ticket pocket.

The present invention also includes a holder adapted to be worn by a user and having a first card, which includes a first insert portion located between a first rear panel and a first front panel. A second card is aligned with the first card and includes a second insert portion located between a second rear panel and a second front panel. The first card and said second card are aligned in such a way that the first rear panel is in facing contact with the second front panel. Also, a generally hidden pocket is formed between the first and second cards by selectively bonding portions of the first and second cards together and an aperture is formed along a portion of an outer periphery of at least said first card.

Yet another embodiment of the present invention includes a holder adapted to be worn by a user and having a first and second card aligned in such a way that predetermined portions of the first and second cards are bonded together. Additionally, at least one hinged panel is connected to one of the first and second cards for providing relative pivotal movement between the hinged panel and the one card. Further, one of the first and second cards includes a panel having multiple layers of material including a first layer having a relatively high melting point and a second layer with a relatively low melting point to facilitate bonding between panels when subjected to increased temperature during assembly.

BRIEF DESCRIPTION OF THE DRAWINGS

The features and inventive aspects of the present invention will become more apparent upon reading the following detailed description, claims, and drawings, of which the following is a brief description:

DETAILED DESCRIPTION OF PREFERRED EMBODIMENTS

Figure 1:
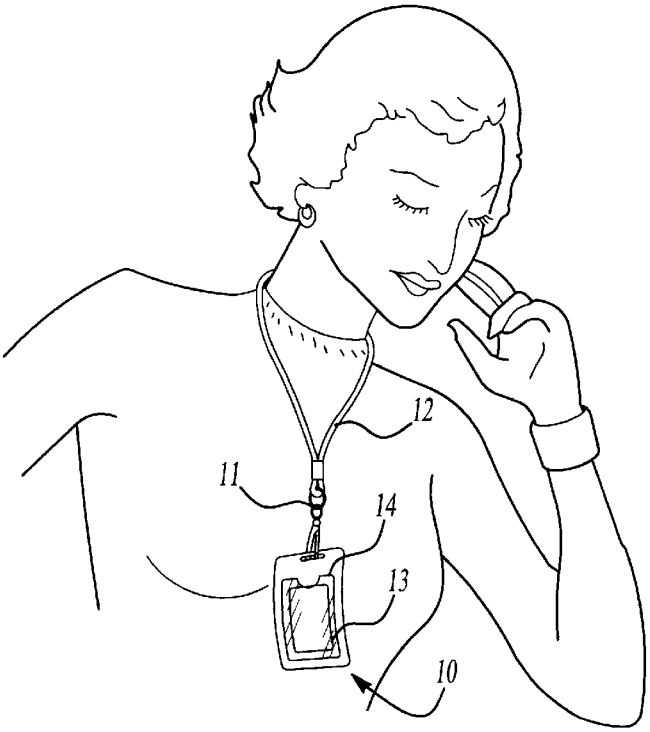
FIG. 1 is a perspective view showing the invention in use around the neck of a patron.

A protective ticket holder 10 is shown in FIG. 1. The holder 10 includes a cord 12, which preferably attaches to the holder by means of a swivel 11. A ticket 13 is received within a front pocket 14, which is fabricated from at least one panel of transparent plastic material.

Figure 3:
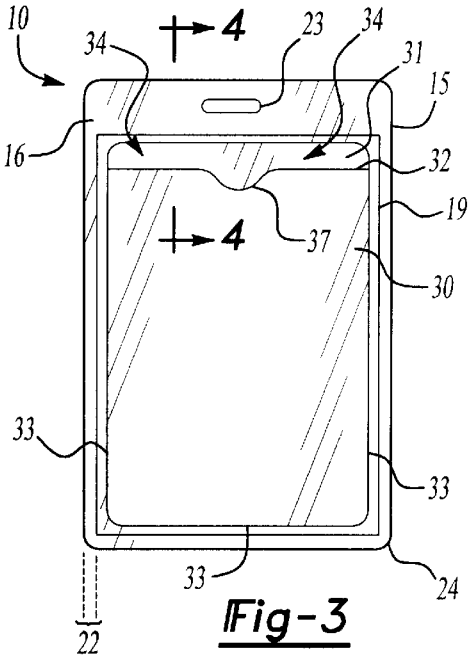
FIG. 3 is a front view of the first embodiment.
Figure 2:
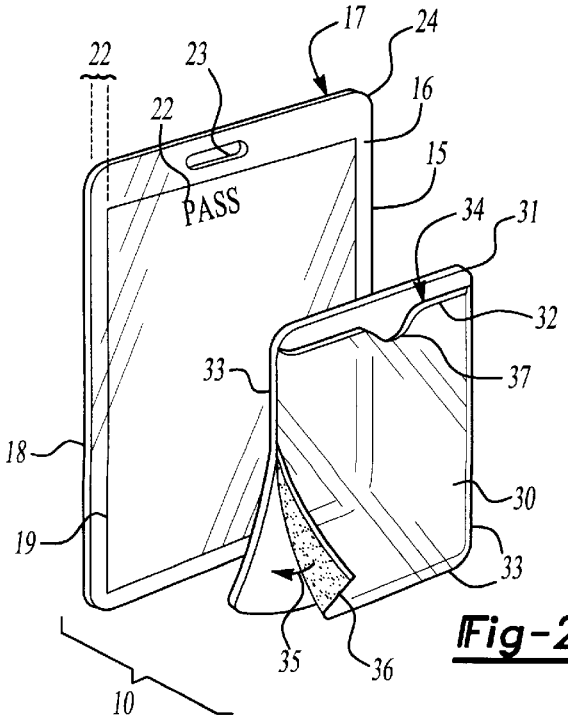
FIG. 2 is an exploded perspective view of a first embodiment of the invention.
Figure 4:
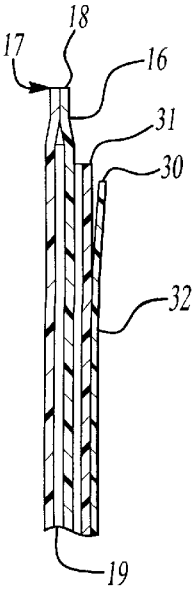
FIG. 4 is a fragmentary cross-sectional view taken along arrows 4—4 of FIG. 3.

As shown in greater detail in FIGS. 2, 3 and 4, ticket holder 10 is provided with a generally rectangular transparent semi-rigid laminated memorabilia card 15 having a front panel 16 and a rear panel 17 with a common outer periphery 18. An insert 19 is disposed between front panel 16 and rear panel 17, having information 21 printed on at least one side of insert 19 in facing contact with a panel of the card. Insert 19 may display team logos or other memorabilia, or else display useful information such as security devices, patron identification, or parking information. A spacing 22 is provided between the outside of insert 19 and outer periphery 18. Bonding of front panel 16 and rear panel 17 along periphery 18 seals insert 19 in place. An aperture 23 is provided generally equidistant between the outer periphery and the outer edge of the insert to releasably engage a means to secure the holder to the patron. Comers 24 of the card are slightly rounded to prevent injury.

A generally rectangular ticket pocket 30 formed of pliable clear plastic includes a rear partition 31 aligned in facing relationship with a front partition 32. Ticket pocket 30 is sealed along three sides 33 and left open along a fourth side 34. Ticket pocket 30 is smaller than card 15, and attached thereto. The front partition 32 of ticket pocket 30 is preferably provided with a thumbnail slot 37 along fourth side 34 to enable easy access to a ticket placed therewithin. Pocket 30 conveniently allows a patron to display a ticket while preventing any undesirable damage to it.

Figure 5:
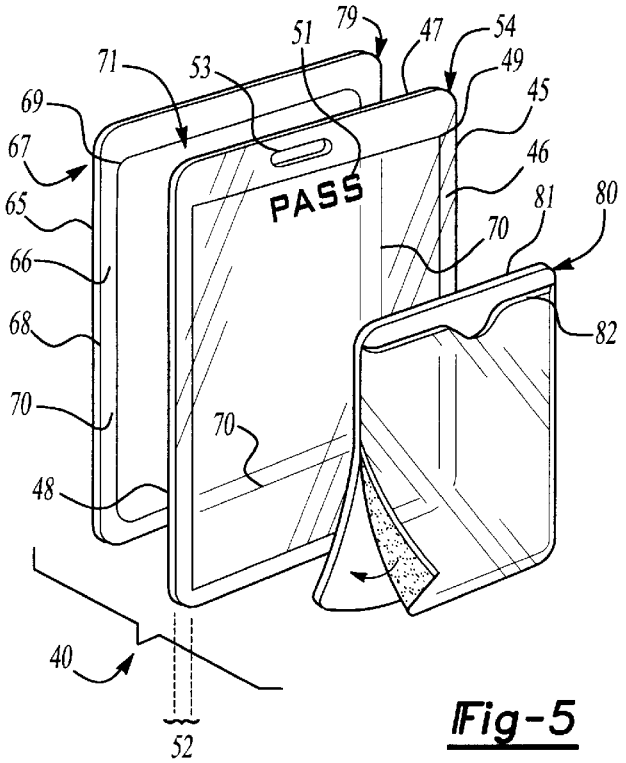
FIG. 5 is an exploded perspective view of a second embodiment of the invention.
Figure 6:
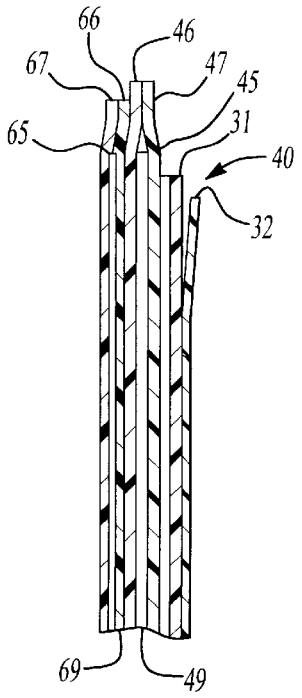
FIG. 6 is a fragmentary cross-sectional view of the second embodiment of the invention.

A second embodiment of the invention is illustrated in FIGS. 5 and 6. The protective ticket holder 40 includes a first generally rectangular transparent memorabilia card 45 having a first front panel 46 and a first rear panel 47 with a first common outer periphery 48. A first insert 49 is disposed between first front panel 46 and first rear panel 47, having information 51 printed on at least the side of insert 49 in facing contact with panel 46. A spacing 52 is provided between the outside of first insert 49 and first outer periphery 48. Bonding of first front panel 46 and first rear panel 47 along periphery 48 seals first insert 49 in place. An aperture 53 is provided generally equidistant between the outer periphery and the outer edge of the first insert to releasably engage a means to secure the holder to the patron. Corners 54 of the card are slightly rounded to prevent injury. Ticket holder 40 additionally includes a second generally rectangular transparent memorabilia card 65 which includes a second front panel 66 and a second rear panel 67 with a second common outer periphery 68. A second insert 69 is disposed between second front panel 66 and second rear panel 67. First card 45 is disposed in facing relationship with second card 65. Second front panel 66 is in facing relationship with first rear panel 47. First card 45 is bonded to second card 65 along three sides 70 to define a pocket 71 therebetween. If first and second inserts 49,69 are opaque, then pocket 71 is concealed. Pocket 71 is particularly useful for holding valuables, currency or identification, or other items which a patron wishes to safeguard or keep from plain view. The second card has rounded comers 79. As best illustrated in FIGS. 6 and 7, ticket holder 40 includes ticket pocket 30 bonded to front panel 46 in the same manner as discussed above with respect to ticket holder 10.

Figure 7:
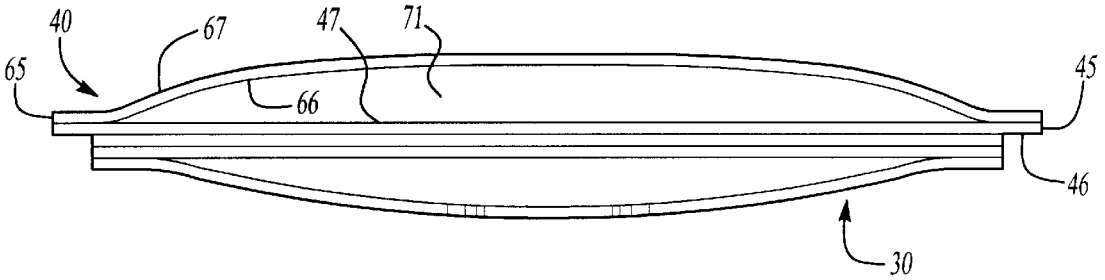
FIG. 7 is a plan view of the second embodiment of the invention.

The advantages of the hidden pocket are further demonstrated in FIG. 7. Ticket pocket 30 is bonded to first front panel 46 of first card 45. Preferably, ticket pocket 30 is formed of transparent material so that printed indicia of interest printed on the first insert is visible when the ticket pocket is empty, or so that a ticket received within the ticket pocket is visible therethrough. Card 65 is bonded to card 45 along three sides forming a hidden pocket 71. Pocket 71 is defined by second front panel 66 and first rear panel 47. Pocket 71 is concealed between first card 45 and second card 65 due to the opaque nature of the inserts disposed within the two cards.

In addition to the advantages of the first embodiment, the second embodiment provides a hidden pocket. The hidden pocket is thereby useful to conceal such things as valuables, currency, identification, or other items the patron wishes to safeguard or keep from plain view.

Figure 8:
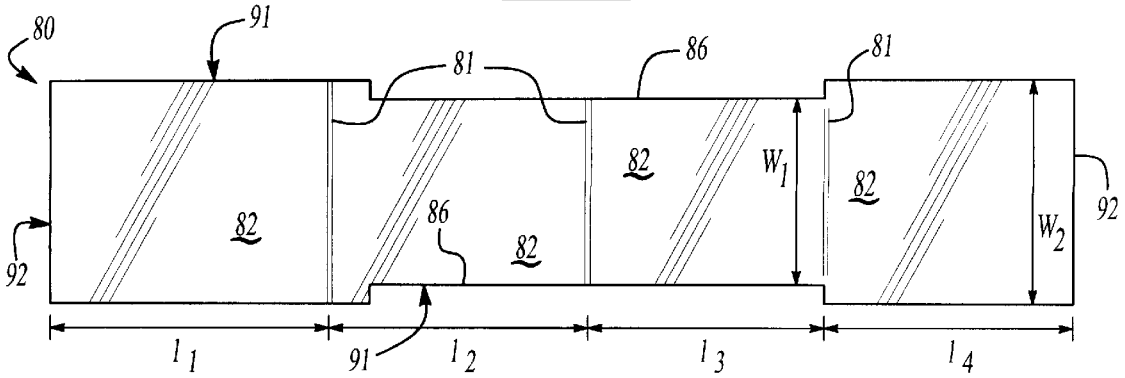
FIG. 8 is a planar view of the third embodiment of the invention.
Figure 9:
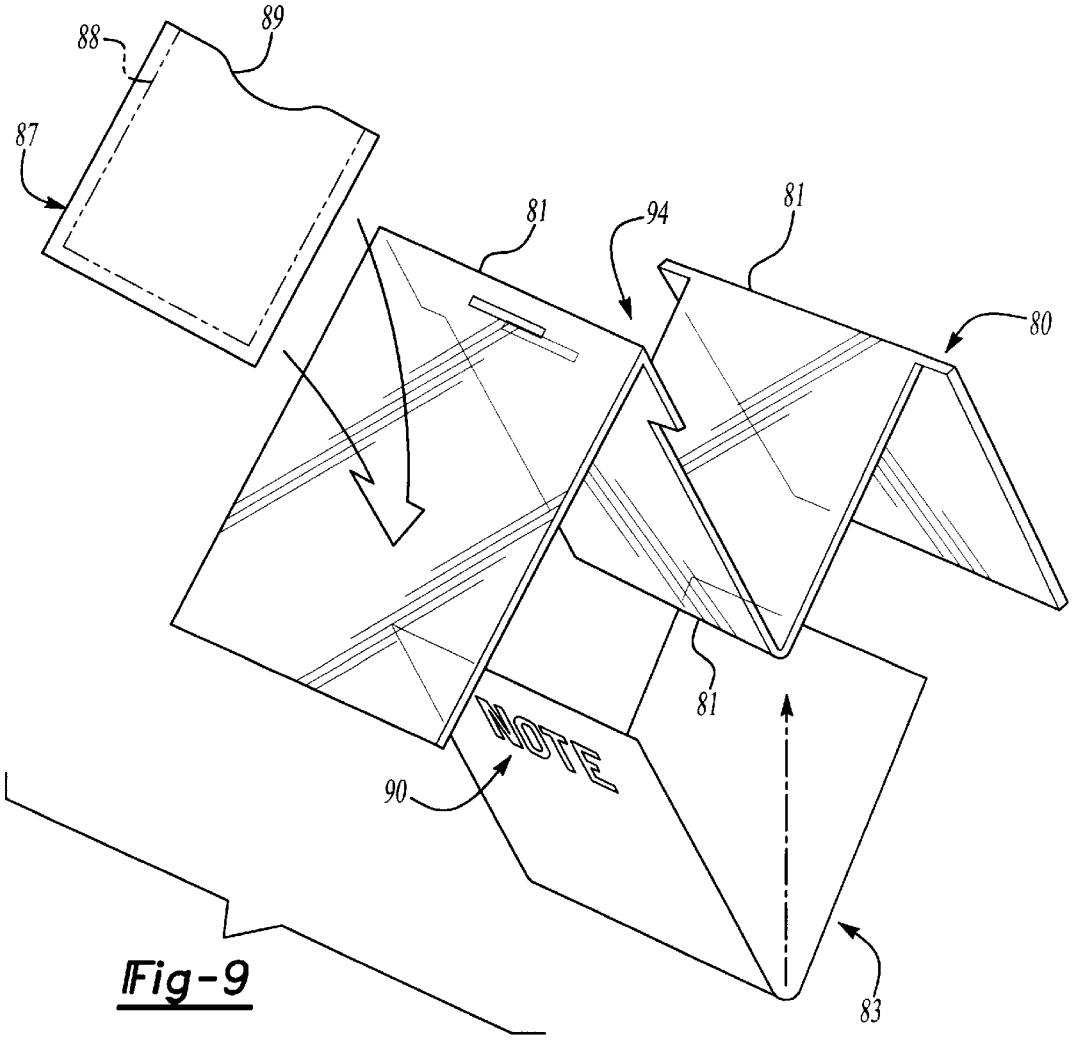
FIG. 9 is an exploded perspective view of the third embodiment of the invention.

A third embodiment and method of constructing the same is depicted in FIGS. 8 and 9. The ticket holder is constructed from a single sheet 80 of flexible transparent plastic material. Sheet 80 preferably has a generally rectangular shape with generally parallel sides 91 longer than adjacent sides 92. An odd number of fold lines 81 are formed in a direction perpendicular to the side 91, thereby creating an even number of panels 82. As best seen in FIG. 9, the fold lines 81 are formed in alternating opposite directions so that the sheet is provided with an accordion-like shape. When folded along fold lines 81, the panels 82 are brought into a superimposed substantially parallel arrangement. A printed insert 83 may be placed within the folds such that printed information 90 is in facing contact with at least the outermost panels of the sheet. The insert is fixed within the sheet by sealing the sheet along the portion of the outer periphery of the outermost panels which does not include fold lines 81. The insert 83 may also be formed from a single sheet of material. The shape of insert 83 may conform to the shape of the sheet 80. Insert 83 may also be folded into an accordion-shape and inserted between multiple panels of the sheet, and may display printed information upon any face in contact with a panel of the sheet.

As shown best in FIG. 8, the sheet may further include a recessed edge 86 substantially along the portion of side 91 lying between the outermost panels. In this way, a width $w_1$ between the recessed edges is less than a width $w_2$ of the outermost panels. Additionally, the length of the panels is adjusted such that lengths $l_1$ and $l_4$ are greater than lengths $l_2$ and $l_3$. When the sheet is folded along fold lines 81 into a superimposed substantially parallel arrangement, only the outside three edges of the outermost panels which do not include fold lines are sealed together. Thus, instead of sealing together all panels, only the two outermost panels need be sealed together to fix the insert within the assembly. The width of insert 83 should not exceed $w_1$ in such an assembly.

Ticket pocket 87 is thereafter attached to an external face of one of the outermost panels. Ticket pocket 87 is made from a single rectangular piece of transparent plastic material and is coated along the border of three sides with a transparent pressure sensitive adhesive 88, with which ticket pocket 87 is attached to the panel. A thumbnail slot 89 is provided along the unsealed fourth side of ticket pocket 87.

With the method disclosed by the third embodiment, the transparent ticket pocket may be readily assembled from a single piece of transparent material. Additionally, the printed insert may be placed easily between a number of adjacent panels and may display information upon any face adjacent to any panel. The recessed edge provides superior bonding because only one seal is created between the two outermost panels, without the interposition of any part of any other panel between the two outermost panels. Additionally, a concealed pocket 94 is formed between the outermost panels, having a top opening defined by a fold line of the shorter of the outermost panels.

Figure 10:
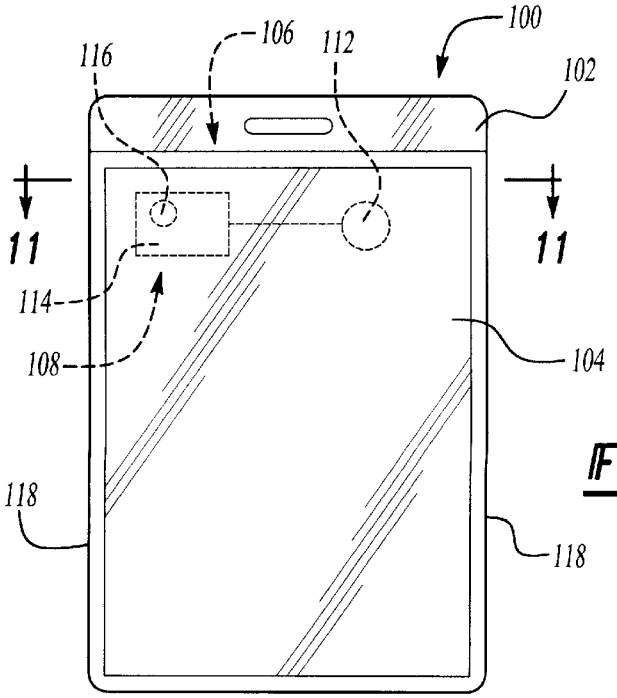
FIG. 10 shows a further embodiment according to the present invention.
Figure 11:
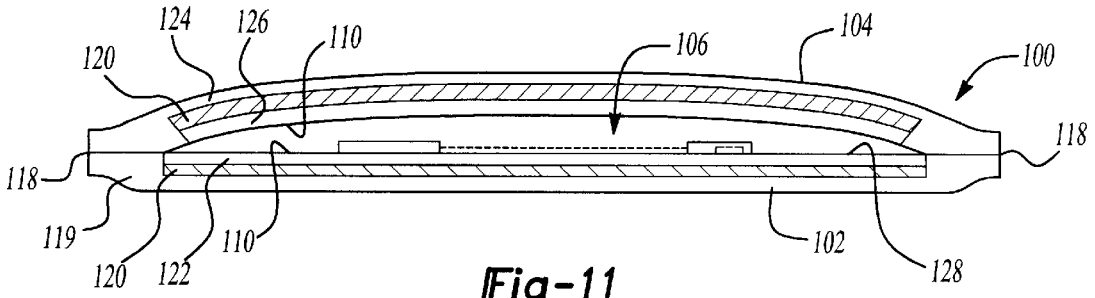
FIG. 11 is cross-sectional view taken along lines 11—11 of FIG. 10.

Next, FIGS. 10 and 11 show a hidden pocket holder 100 having a first transparent memorabilia card 102 connected to a second transparent memorabilia card 104 such that a hidden pocket 106 is formed for example to conceal valuables, currency, identification, or other items that a user wishes to safeguard or keep from plain view. Transparent memorabilia cards 102, 104 can be fabricated in accordance with any of the disclosed embodiments that have a hidden pocket. An audio source 108 for making audio sounds, such as music, is located within hidden pocket 106 and can be selectively activated by a user to play, for example, a sports team's fight song. However, the present invention is not limited only to sporting events. It can be used for a wide variety of events including, but not limited to, concerts, amusement parks, outdoor activities where a user does not desire to carry a wallet or purse, conventions, or school field trips. Also, if desired, the present embodiment can optionally include a ticket pocket (not shown) like those disclosed in accordance with other embodiments of the present invention.

Audio source 108 can be located on a hidden exterior surface 110 of either first card 102 or second card 104, or both. However, to avoid potential interference with access to hidden pocket 106, audio source 108 can be located partially, or entirely, within the first or second cards 102, 104. Audio source 108 preferably includes a speaker 112 connected to a sound generator 114 having a power source 116. However, any suitable device, or combination of devices, capable of generating an audible signal is envisioned to be used. To selectively activate audio source 108, a user squeezes outer edges 118 together, which tends to open hidden pocket 106 and completes a circuit causing audio source 108 to generate sound. When squeezing force is released, first and second cards 102, 104 flatten out, tending to close hidden pocket 106 and the circuit is broken. However, any other suitable method for activation can be used, including a mercury switch or button.

FIG. 11 shows a cross-section of hidden pocket holder 100 with first card 102 including an outer panel 119 adjacent to an insert portion 120 and an inner panel 122. Second card 104 similarly includes an insert portion 120 sandwiched between an outer panel 124 and an inner panel 126. In the illustrated embodiment, audio source 108 is located on a surface 128 of inner panel 122 which opposingly faces inner panel 126 of second card 104. However, as mentioned above, to avoid potential interference with access to hidden pocket 106, audio source 108 can be located partially, or entirely, within first or second cards 102, 104 or both.

Figure 12:
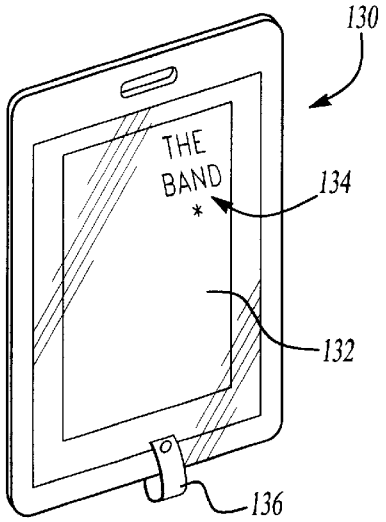
FIG. 12 is a perspective view of a further variation of the present invention having a reflective mirror.

FIG. 12 shows a holder 130 having a mirror element 132 for providing a reflective surface in which a user can readily see her reflection. Mirror element 132 is preferably a thin metal foil having a highly reflective surface, such as aluminum. One benefit of a thin metal foil is that holder 130 can withstand bending and impact forces without breaking or degrading mirror element 132. However, any suitable material capable of acting as a mirror can be used. Mirror element 132 is useful for a variety of personal matters, including, applying and checking mascara, combing hair and attending to contact lenses. Optionally, but preferably, mirror element 132 includes indicia 134 thereon. Indicia 134 can be formed, for example, by printing, embossing or etching and provides a greater degree of flexibility for including marketing and promotional information. Another optional but preferable structure is a retainer 136 for removably securing any suitable item, including for example a cosmetic applicator, i.e. a tube of lipstick. Retainer 136 is illustrated as a full loop of elastic material, however, other retainers that are capable of removably securing items can be used, including, but not limited to, hook and loop type fasteners such as VELCRO, snaps, clips, magnets, hooks and buckles.

Holder 130 can be made in accordance with any of the disclosed embodiments including fabrication from a single piece of material that is folded or from multiple different pieces. Moreover, holder 130 does not necessarily require the presence of either a hidden pocket or a ticket pocket. Thus, hidden pockets and ticket pockets are optional, alternative features for holder 130. Further, any of the disclosed embodiments can include one or more mirror elements located on any surfaces, as desired.

Figure 13:
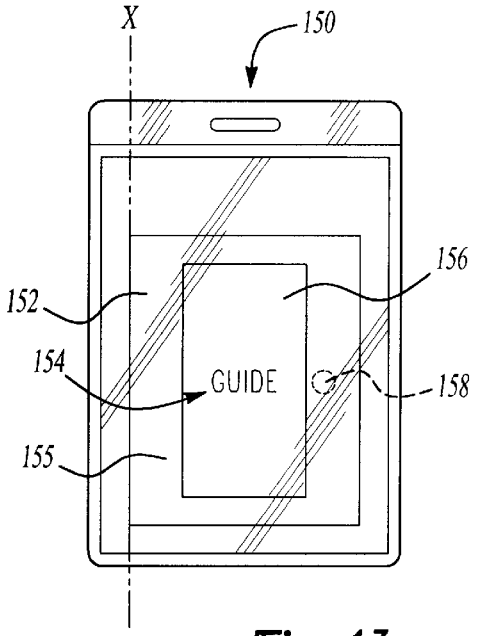
FIGS. 13–15 illustrate a further embodiment of the present invention having a hinged panel.
Figure 14:
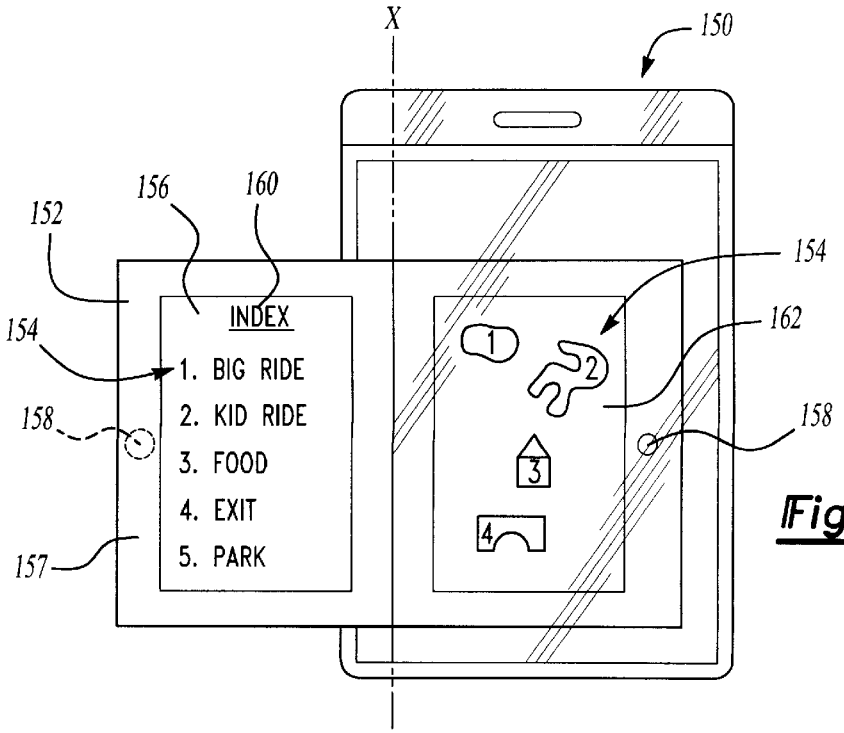
Figure 15:
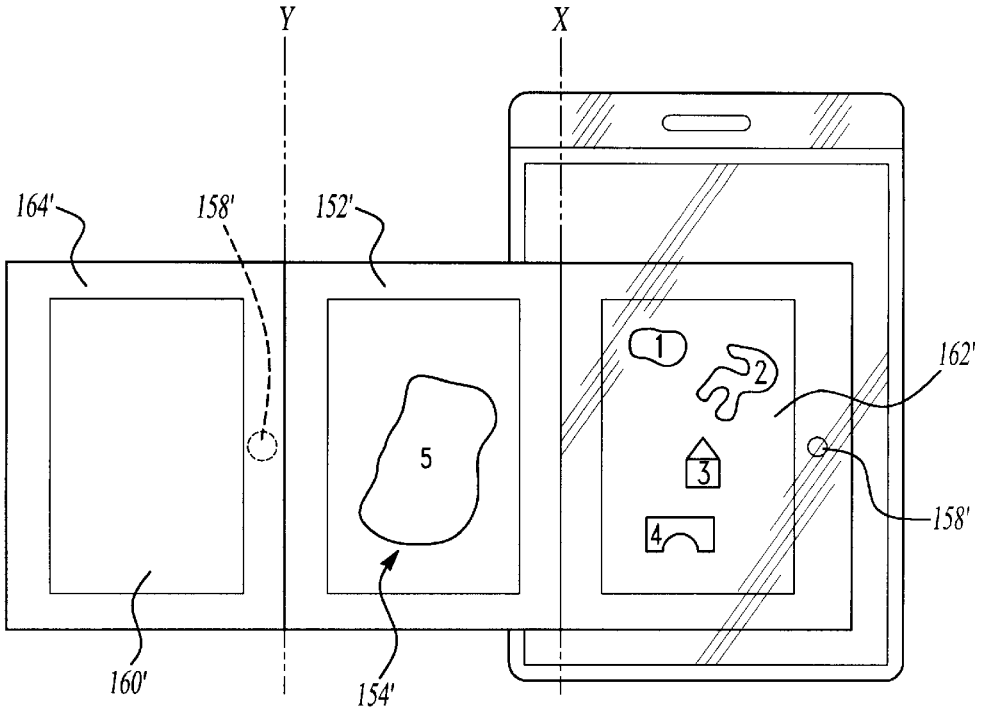

FIGS. 13–15 show a further embodiment of the present invention having a holder 150 that includes at least one hinged panel 152 that is at least partially rotatable about an axis X. Hinged panel 152 can optionally include many types of indicia 154, but preferably includes information in the form of a map or guide for a particular place, such as an amusement park, shopping mall, sporting event, stadium, ski mountain or tourist attractions. Thus, a user can readily access important information at any time without searching through multiple different pockets in pants, coats, or bags. In addition, the likelihood of misplacing the information is greatly decreased since a user has holder 150 attached to his person and has no need for removing holder 150.

The at least one hinged panel 152 optionally but preferably includes a front and rear transparent panel 155, 157 and insert 156 that is preferably laminated between front and rear panels 155, 157 to prevent damage from dirt, food, drinks, rain, water, water rides, etc. Laminating also provides rigidity to insert 154 to ensure easy viewing. One or more securing elements 158 are optionally but preferably provided to maintain hinged panel 152 in a closed position adjacent holder 150. Hook and loop type fastener portions positioned in facing relation to each other on holder 150 is one suitable securing element. However, any suitable securing element including snaps, clips and magnets can be utilized. FIG. 14 shows a hinged panel 152 that pivots about axis X and has in inner surface 160 with indicia 154. A fixed panel 162 optionally includes indicia 154 for viewing by a user. Fixed panel 162 can be a separate panel that is hingedly connected to hinged panel 152 or it can be any one of the card surfaces of holder 150.

FIG. 15 shows a further embodiment having a holder 150' with a second hinged panel 164' connected between first hinged panel 152' and fixed panel 162'. Thus, the addition of second hinged panel 164' creates a multiple panel fold-out effect including, for example, an accordion-type folding and provides a second axis Y for rotation of first hinged panel 152' relative to second hinged panel 164'. Axes X and Y are illustrated as generally parallel, however, any desired relationship can be used. Securing element 158' on second hinged panel 164' cooperates with securing element 158' on fixed panel 162' to releasably hold first and second hinged panels 152', 164' in a closed, generally flat position. Moreover, any number of hinged panels can be provided. In addition, the hinged panels may pivot or rotate about any axis orientation including being pivotally attached by one pivot axis for panel movement parallel to holder 150'. Thus, the present invention is not limited to only the illustrated embodiment.

Further, the embodiment of FIGS. 13–15 can be combined with any of the features of the disclosed embodiments. For example, holder 150 can optionally include a hidden pocket, a ticket pocket, or both.

Figure 16:
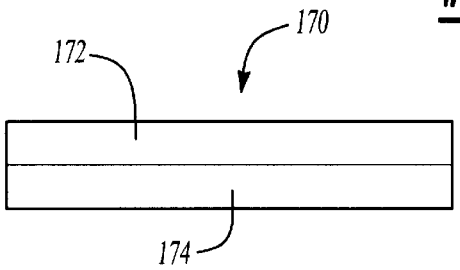
FIGS. 16, 17(*a*)–7(*d*), 18, 19 show alternate patterns for constructing a holder.
Figure 17A:
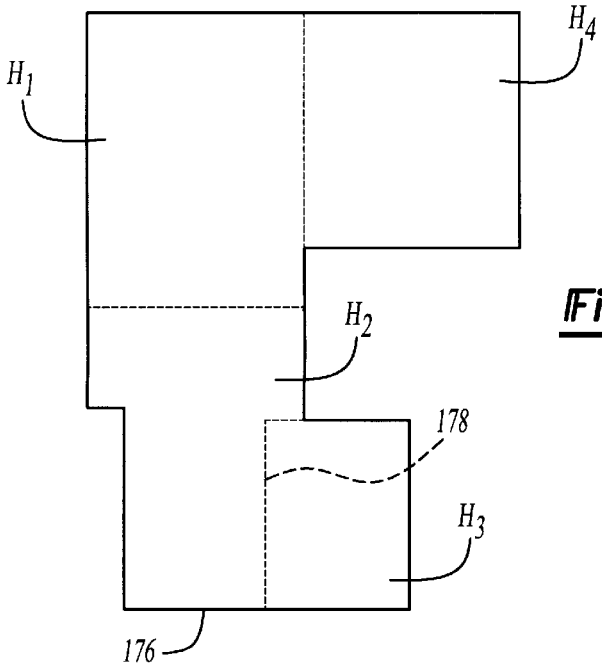
Figure 17B:
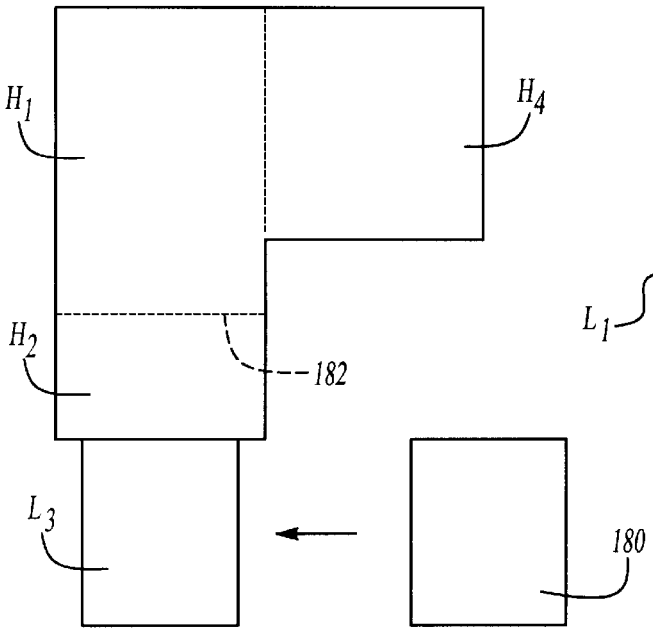
Figure 17C:
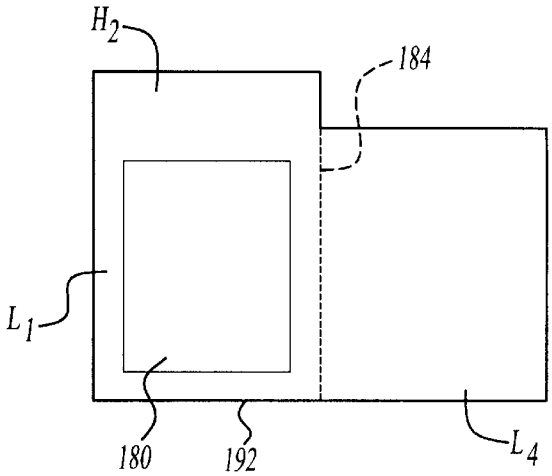
Figure 17D:
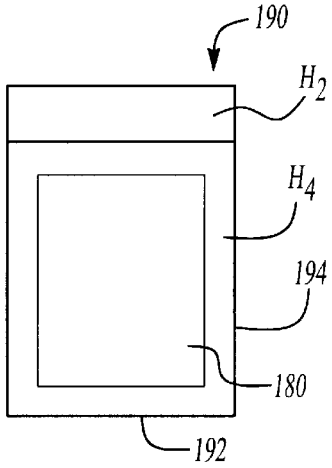

FIGS. 16, 17(*a*)–17(*d*), 18 and 19 show alternate patterns for constructing a holder from a single sheet 170 of transparent plastic material. The description relating to single sheet fabrication shown in FIGS. 8 and 9 is equally applicable to the present embodiment, including for example, dimensional relationships. Preferably, single sheet 170 is a multi-layer sheet having a relatively higher melting point upper layer 172 connected to a relatively lower melting point lower layer 174. More specifically, upper layer 172 can be formed of polyester and lower layer 174 can be polyethylene. However, any suitable materials can be used including, but not limited to, polypropylene and polyethylene. FIG. 17 shows one representative pattern with high melting point upper layer 172 in view. A first high melting point region H1 is located above and adjacent to a generally T-shaped region H2 that has a laterally offset region H3 located along a lower portion thereof. Preferably, regions H3 and H2 have a common width and a common lower edge 176 to create a generally continuous edge after folding. Another region H4 is laterally offset from region H1 and has a same width as region H1. Moreover, region H1 is slightly longer than region H2 to ensure sealing of L4 against region L1 along a common bottom edge 192. Region L1 is located on the back of region H1 and is not shown in the drawings. Region H4, however, has a shorter length than regions H1, H2 such that when folded, region H4 does not fully cover region H2. As illustrated in FIG. 17(*b*), region H3 is folded over fold line 178 onto region H2 and partially covers region H2. Lower melting point region L3 is now on top and is generally aligned with region H1 and the remaining uncovered region H2. Next, one or more inserts 180, including a folded insert, can be positioned such that further folding of sheet 170 captures one or more inserts 180. As illustrated in FIGS. 17(*c*) and 17(*d*), region H1 is folded backward over fold line 182 such that region L1 (not shown) is generally below regions H2 and L3. Next, region L4 is folded along fold line 184 inwardly toward region L3 over insert 180 such that region H2 remains partially uncovered. Upon being folded, sheet 170 forms a holder 190. Holder 190 is then subjected to increased temperatures whereby the lower melting point regions L1–L4 bond to one another along predetermined areas of interfacing contact. For example, regions L1 and L4 contact along lowermost edge 192 and along portions of side edges 194 located laterally outward of region L3 and insert 180.

Figure 18:
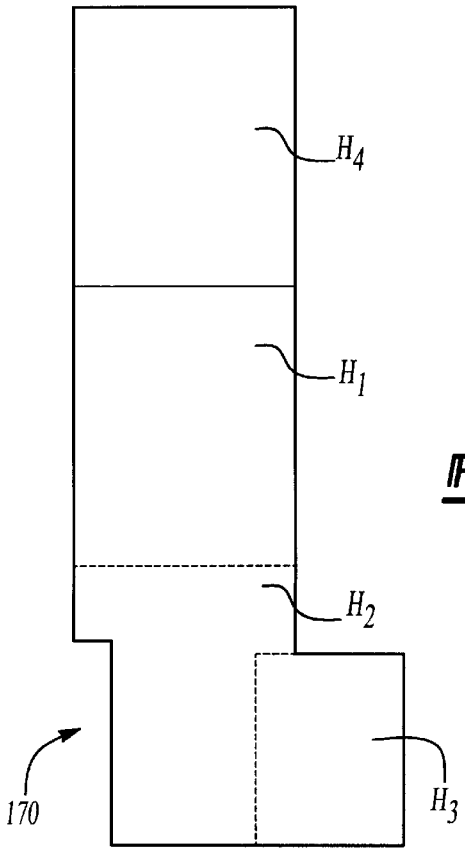

FIG. 18 shows a different placement for region H4. It should be understood that many different variations for folding a single sheet are contemplated by the present invention, illustrated examples are merely representative.

Figure 19:
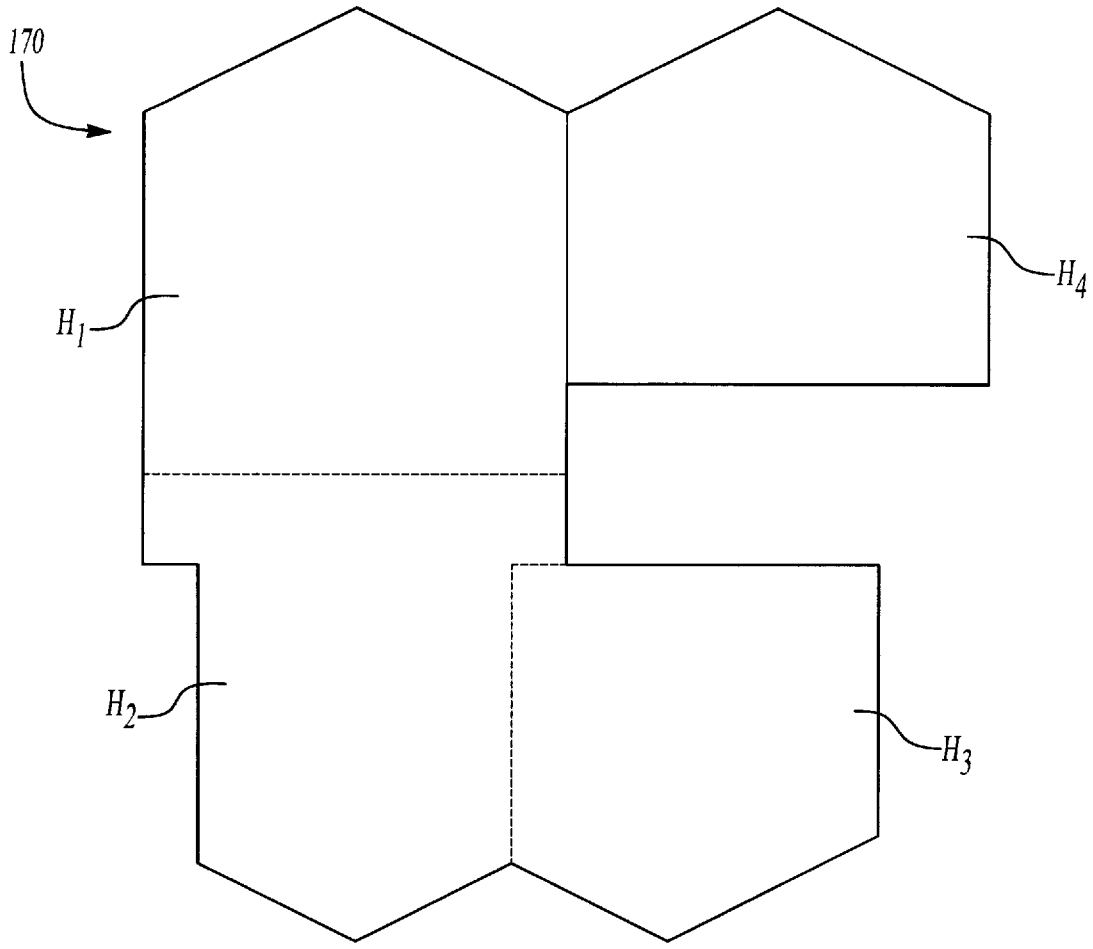

FIG. 19 shows a further variation of sheet 170 having generally pentagon-shaped regions. However, any suitable geometric shape or combination of shapes can be used.

Figure 20:
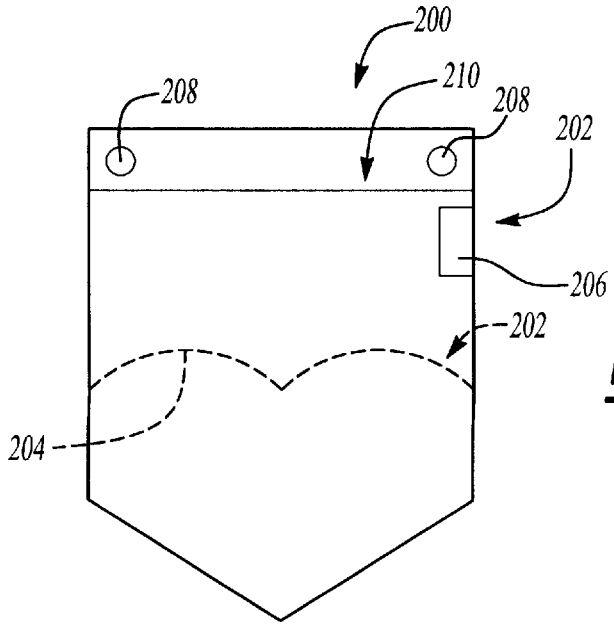
FIG. 20 shows a further embodiment of the present invention.

FIG. 20 illustrates a holder 200 having a general shape of a pentagon and further includes indicia 202 that relates to a pants pocket or shirt pocket. Indicia 202 can be provided on an insert (not shown) or applied using other suitable methods. Indicia 202 can include, for example, simulated stitching 204 and a simulated tag 206 and include a denim-type pattern of coloring. One or more apertures 208 are optionally provided for securing to a user, as for example in a manner similar to a purse strap. Optionally, but preferably, a hidden pocket 210 is provided to store items in a similar manner as previously described. A further optional feature includes a ticket pocket (not shown) located on holder 200 for storing of a ticket stub or similar article.

Preferably, apertures of any desired shape, number or size are provided in each of the disclosed embodiments to facilitate attachment of the instant invention to a user. A securing element can be connected to a respective aperture to achieve a convenient attachment. Non-limiting examples of such securing elements includes hook and loop type fasteners, a lanyard, clip, pin, strap, belt, cord, loop or hook. However, any suitable securing element can be used.

Further modifications include the use of transparent panels, opaque panels or combinations of both transparent and opaque panels, as may be desired to control visual access through a particular panel.

Moreover, the use of a single planar insert versus a folded insert versus plural inserts is contemplated by the present invention. Any type of insert can be utilized as required for reasons of economy, manufacturing or appearance.

Similarly, all of the holders of the present invention can be made from either a single sheet of material or multiple individual pieces depending, for example, on quantity, cost, and availability.

Preferred embodiments of the present invention have been disclosed. A person of ordinary skill in the art would realize, however, that certain modifications would come within the teachings of this invention. Therefore, the following claims should be studied to determine the true scope and content of the invention.

What is claimed is:

1. A holder adapted to be worn by a user comprising:

a first card having a first front panel and a first rear panel;

a second card having a second front panel and a second rear panel;

said first front panel including a periphery which is directly bonded to portions of a periphery of the second front panel in order to form a pocket between the first and second front panels, and at least one hinged panel connected to one of said first and second cards for providing relative pivotal movement about an axis between the hinged panel and the one card to permit selective viewing of substantially an entire inner surface of said hinged panel when a lateral peripheral edge of said hinged panel is pivoted away from the one card.

2. The holder of claim 1, further comprising an aperture formed along a portion of an outer periphery of at least said first card for receiving a retaining element that permits attachment of the holder to a user.

3. The holder of claim 1, wherein a generally hidden pocket is formed between said first and second cards by the bonding of the predetermined portions of said first and second cards.

4. The holder of claim 1, wherein said hinged panel comprises a third rear panel and a third front panel, wherein an insert portion is positioned between said third rear and front panels.

5. The holder of claim 1, wherein said at least one hinged panel comprises multiple panels that can be selectively displayed by pivoting of said hinged panels.

6. The holder of claim 1, further comprising a generally transparent ticket pocket including at least one ticket panel, said ticket panel being bonded to one of said first and second cards.

7. The holder of claim 1, further including a securing element located on at least said hinged panel to releasably secure the hinged panel in a closed position adjacent one of said first and second cards.

8. The holder of claim 7, wherein said securing element comprises one of a snap, a magnet and a hook and loop type fastener.

9. The holder of claim 7, wherein one of said first and second cards includes a panel having multiple layers of material including a first layer having a relatively high melting point and a second layer with a relatively low melting point.

10. A holder adapted to be worn by a user comprising:

a first card, said first card including a first insert portion located between a first rear panel and a first front panel;

a second card, said second card including a second insert portion located between a second rear panel and a second front panel;

wherein said first card is positioned in facing relationship with said second card with said second card aligned with said first card such that said second front panel of said second card is in facing contact with said first rear panel of said first card;

a generally hidden pocket formed between said first and second cards by selectively bonding portions of said first and second cards directly together;

at least one hinged panel connected to one of said first and second cards such that said hinged panel may be selectively pivoted about a predetermined axis to permit viewing of substantially an entire inner surface of said hinged panel when a lateral peripheral edge of said hinged panel is pivoted away from the one card; and an aperture formed along a portion of an outer periphery of at least said first card.

11. The holder of claim 10, wherein said hinged panel includes a third rear panel and a third front panel.

12. The holder of claim 11, wherein said third front and rear panels are transparent, said third front and rear panels receiving an insert portion positioned between said third rear and front panels.

13. The holder of claim 10, wherein said at least one hinged panel comprises multiple panels.

14. The holder of claim 13, wherein said multiple panels unfold to selectively display indicia located on at least one of said multiple panels.

15. The holder of claim 10, further including a securing element located on at least said hinged panel to releasably secure the hinged panel in a closed position adjacent one of said first and second cards.

16. The holder of claim 10, wherein one of said front and rear panels of said first and second cards has multiple layers of material including a first layer having a relatively high melting point and a second layer with a relatively low melting point.

17. The holder of claim 10, further comprising a retaining element connected to said aperture to permit attaching the holder to a user.

* * * * *